US005941803A

United States Patent [19]

Chamberlain et al.

[11] Patent Number: 5,941,803

[45] Date of Patent: Aug. 24, 1999

[54] EXERCISE APPARATUS

[76] Inventors: James Chamberlain, 27020 N. Longwood Rd., Lake Forest, Ill. 60045; Mark Cibrario, 108 Wildflower Cir., Buffalo Grove, Ill. 60089; Barry Slotnick, 1418 Ridge Rd., Northbrook, Ill. 60062

[21] Appl. No.: 08/873,572

[22] Filed: Jun. 12, 1997

[51] Int. Cl.[6] ..... A63B 21/068

[52] U.S. Cl. ..... 482/96; 482/70; 482/51

[58] Field of Search ..... 482/95, 96, 70, 482/54, 53, 51, 90

[56] References Cited

U.S. PATENT DOCUMENTS 4,706,953 11/1987 Graham .
4,775,150 10/1988 Graham .
4,779,862 10/1988 Keppler .
4,884,802 12/1989 Graham .
5,042,797 8/1991 Graham .
5,114,387 5/1992 Keppler .
5,364,327 11/1994 Graham .

*Primary Examiner*—Richard J. Apley
*Assistant Examiner*—William LaMarca
*Attorney, Agent, or Firm*—Mark R. Galis

[57] ABSTRACT

An exercise apparatus having a frame including a base, a plurality of support members extending upward from the base, a slide board carrying member carried by a first group of the plurality of support members, and a platform carrying member carried by a second group of the plurality of support members. A slide board is carried by the slide board carrying member and generally resides in a plane which is angled with respect to horizontal while a platform is carried by the platform carrying member and generally resides in a plane which is parallel with respect to horizontal. A pair of channels between which said slide board is generally disposed is provided for use in carrying a reciprocable shuttle. A plurality of upwardly extending poles is also provided which are preferably adapted to be removably mated with a corresponding number of said plurality of support members.

10 Claims, 9 Drawing Sheets

EXERCISE APPARATUS

BACKGROUND OF THE INVENTION

This invention relates generally to exercise equipment and, more particularly, relates to an exercise apparatus which is configured to allow the user to perform multiple forms of exercise thereon.

In the prior art, there is known various exercise apparatus, such as plyometric shuttle devices, cross country ski machines, and slide boards, which are configured to allow the user to perform a single, dedicated form of exercise thereon. Plyometric shuttle devices, such as those disclosed in U.S. Pat. Nos. 4,706,953, 4,775,150, 4,884,802, 5,042,797 and 5,364,327, comprise a shuttle on which the user lies which is moveable along a track against the force of elastic tubing or coils which is connected between the shuttle and the track. Slide boards, such as those disclosed in U.S. Pat. Nos. 4,779,862 and 5,114,387, comprise a sheet of low friction material disposed between a pair of foot bumpers against which the user pushes off to simulate skating.

While these dedicated exercise apparatus work for their intended purposes, there are disadvantages associated with their use. For example, should the user desire to perform multiple forms of exercise, multiple dedicated exercise apparatus would have to be purchased. Furthermore, the use of multiple exercise apparatus requires the user to move between the apparatus to perform the desired forms of exercise resulting in an inefficient use of the time of the user. Accordingly, a need exists for an exercise apparatus which will allow the user to perform multiple forms of exercise at a relative cost savings while maximizing workouts in a time efficient manner.

As a result of this existing need, it is a general object of the present invention to provide an exercise apparatus which may be used to perform a plurality of forms of exercise. More specifically, it is an object of the present invention to provide a single exercise apparatus which will allow the user to perform all those exercises presently performed on currently existing plyometric shuttle devices, cross country ski machines, and slide boards as well as other exercises such as single-leg squats, multiple lunges, multi-position leg presses, leg curls, heel raises, and pull-up exercises among other exercises which cannot be readily performed on other pieces of commercially available equipment. It is another object of the present invention to provide an exercise apparatus which allows the user to train the muscular and nervous systems for a variety of benefits including strength, power, endurance, stability, and dynamic flexibility. It is still a further object of the present invention to provide an exercise apparatus which provides a means for overloading the lower body in a closed chain fashion while at the same time reducing the stressful forces placed upon the knees, lower back musculature, and intervertebral discs. It is yet a further object of the present invention to provide an exercise apparatus which improves upon the currently existing plyometric shuttle devices, cross country ski machines, and slide boards.

SUMMARY OF THE INVENTION

In accordance with these objects, the present invention generally resides in an exercise apparatus which includes a slide board, a bumper associated with a side of the slide board, a pair of channels between which the slide board is generally disposed, and a reciprocable shuttle adapted to be removably carried within the pair of channels. In this manner, a single exercise apparatus is provided having the base advantages associated with plyometric shuttle devices and slide boards. The invention also generally resides in an exercise apparatus which includes a frame having a base, a plurality of support members extending upward from the base, and a slide board carrying member carried by the plurality of support members, a slide board carried by the slide board carrying member which generally resides in a plane which is angled with respect to horizontal, a bumper associated only with the lower most side of the slide board, and a plurality of upwardly extending poles connected to the frame and disposed between the lower most side and the upper most side of the slide board. In this manner, a single exercise apparatus is provided having the base advantages associated with slide boards and cross country ski machines.

More specifically, the invention resides in an exercise apparatus having a frame including a base, a plurality of support members extending upward from the base, a slide board carrying member carried by a first group of the plurality of support members, and a platform carrying member carried by a second group of the plurality of support members. A slide board is carried by the slide board carrying member and generally resides in a plane which is angled with respect to horizontal while a platform is carried by the platform carrying member and generally resides in a plane which is parallel with respect to horizontal. A pair of channels between which said slide board is generally disposed is provided for use in carrying a reciprocable shuttle. A plurality of upwardly extending poles is also provided which are preferably adapted to be removably mated with a corresponding number of said plurality of support members. In this manner, a single exercise apparatus is provided which fulfills all of the objects set forth above.

A better understanding of the objects, advantages, features, properties and relationships of the invention will be obtained from the following detailed description and accompanying drawings which set forth an illustrative embodiment and are indicative of the various ways in which the principles of the invention may be employed.

BRIEF DESCRIPTION OF THE DRAWINGS

For a better understanding of the invention, reference may be had to the preferred embodiments shown in the following drawings in which.

DETAILED DESCRIPTION

Figure 2:
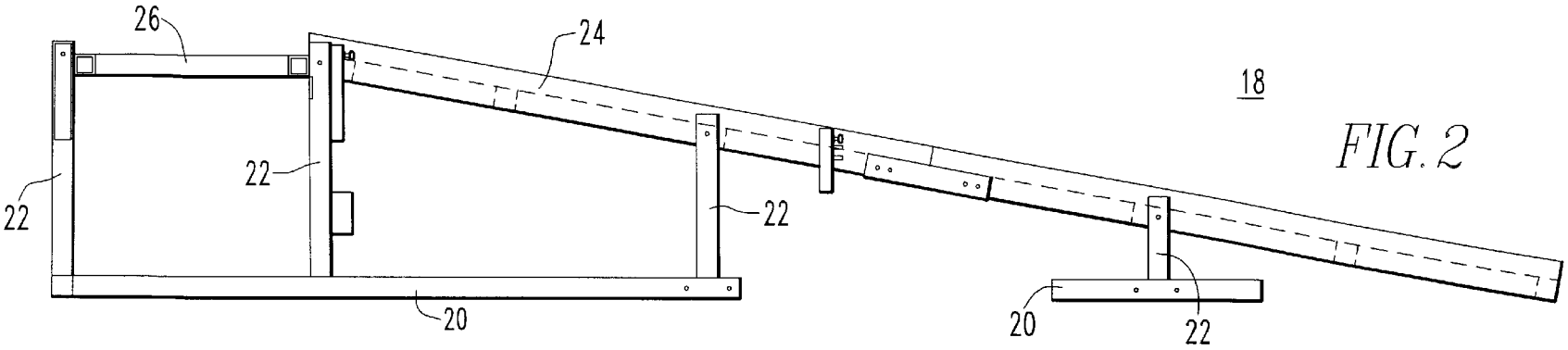
FIG. 2 illustrates a side view of a side frame subassembly used in the construction of the apparatus of FIGS. 1A–B.

Referring now to the figures, wherein like reference numerals refer to like elements, there is generally illustrated embodiments of an exercise apparatus 10 constructed in accordance with the present invention. The apparatus 10 comprises a frame 12 which supports an inclined slide board 14 and a generally horizontal platform 16. The frame 12 preferably includes a pair of oppositely disposed, identical side frame subassemblies 18, illustrated in FIG. 2, each of which is comprised of base members 20 from which extend upright supports 22. Carried between the upright supports 22 of each side frame subassembly 18 is a slide board carrying assembly 24 and a platform carrying member 26. The slide board carrying assembly 24 generally comprises a pair of oppositely disposed side members between which are carried a plurality of joists. The slide board 14, which may be constructed from particle board, plywood or the like, is mounted to the side board carrying assembly 24 while the platform 16 is mounted to the platform carrying member 26. In the preferred embodiment of the invention, the slide board 14 is carried by the frame 12 at an angle of approximately 10 degrees from horizontal although the angle can be varied depending on the size of the unit. Furthermore, the upright supports 22 are constructed from hollow tubing or the like for reasons which will be described in greater detail hereinafter.

Figure 3:
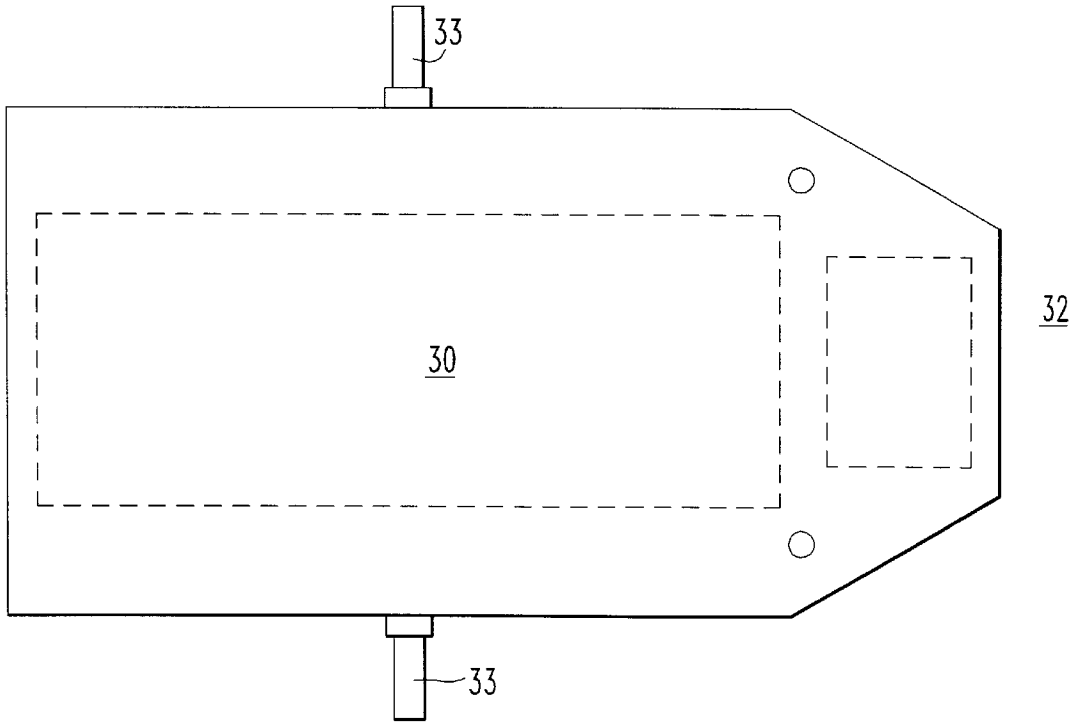
FIG. 3 illustrates a top view of a shuttle used in connection with the form of exercise depicted in FIGS. 1A–1B.
Figure 4:
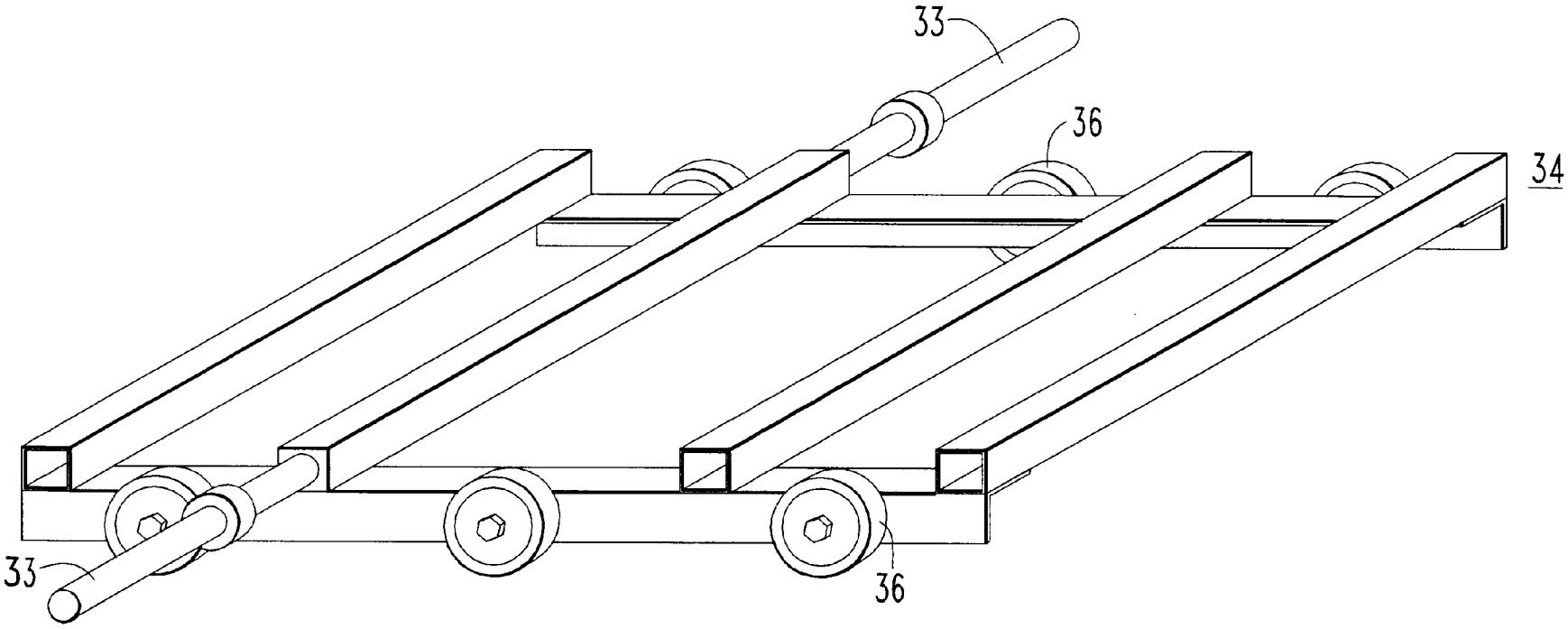
FIG. 4 illustrates a frame member used in the construction of the shuttle illustrated in FIG. 3.

For use in connection with the apparatus 10 is a shuttle 30. As illustrated in FIGS. 3 and 4, the shuttle 30 generally comprises a flat support board 32 carried by a frame assembly 34. In the preferred embodiment of the invention, the flat support board is sized and arranged to accommodate the back and head of the user and includes padding positioned in those areas against which the back and head of the user would rest. The shuttle 30 also includes a plurality of wheels 36 mounted to the frame assembly 34 and a means for allowing the user to engage the shuttle 30 such as handles 38, a harness (not illustrated), or the like.

Figure 1A:
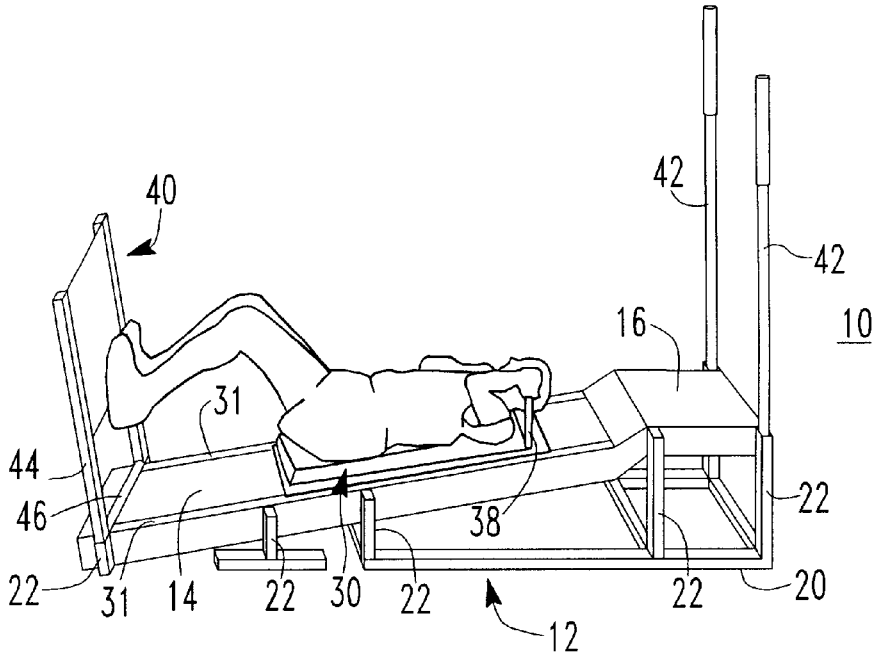
FIGS. 1A–1B illustrate an apparatus constructed according to the present invention being utilized to perform a first form of exercise.
Figure 1B:
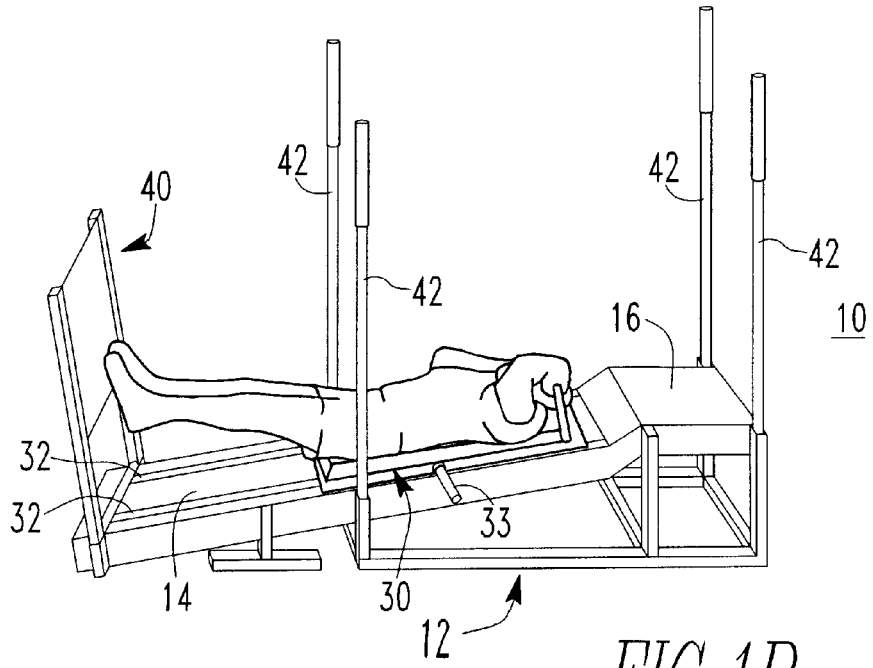

With reference to FIGS. 1A and 1B, the shuttle 30 is specifically provided for allowing the user to lie in a supine position on the shuttle 30 and set the shuttle 30 into reciprocating motion to perform the form of exercise typically performed on dedicated plyometric shuttle devices. In the preferred embodiment of the invention, the apparatus 10 includes a pair of parallel channels 31 (not illustrated) in which the wheels 36 of the shuttle 30 travel. The channels 31 may be formed in or otherwise attached to the slide board carrying member 24 or, in the alternative, to the slide board 14. While not preferred, the shuttle 30 may also be carried directly by the slide board 14 by means of two "skis" or "runners" mounted to the underside of the shuttle which are provided to allow for the movement of the shuttle on the slide surface. A removable foot plate 40, comprised of a generally flat steel plate attached between a pair of oppositely disposed supports 44, is also provided to allow the user to set the shuttle 30 into the reciprocating motion. The supports 44 are sized and arranged to be accepted within the openings found in the upright supports 22 to facilitate the engagement and disengagement of the foot plate 40 with the apparatus 10. The shuttle 30 may optionally be provided with a means for allowing free weights to be attached 33 thereto for purposes of overloading the device. Similarly, a means for attaching an elastic cord 32 between the shuttle 30 and the apparatus 10 would be provided for the same purpose.

Figure 5A:
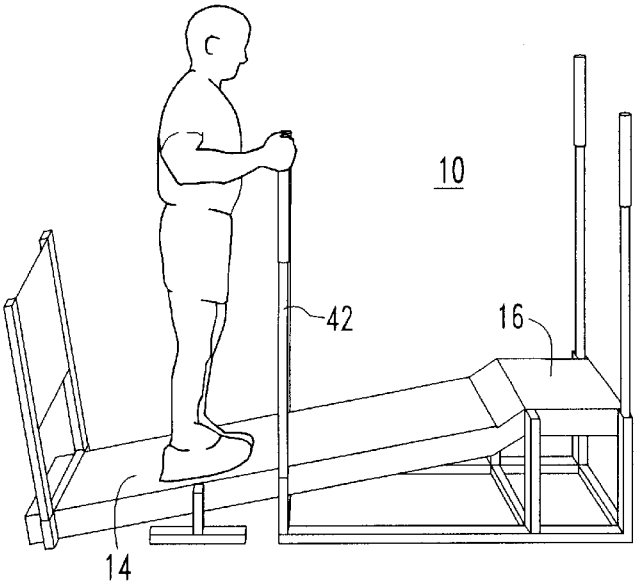
FIGS. 5A–5C illustrate an apparatus constructed according to the present invention being utilized to perform a second form of exercise.
Figure 5B:
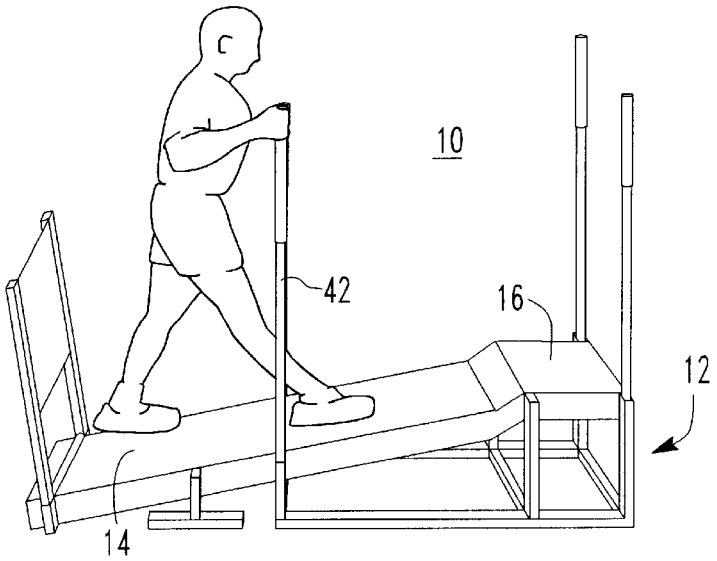
Figure 5C:
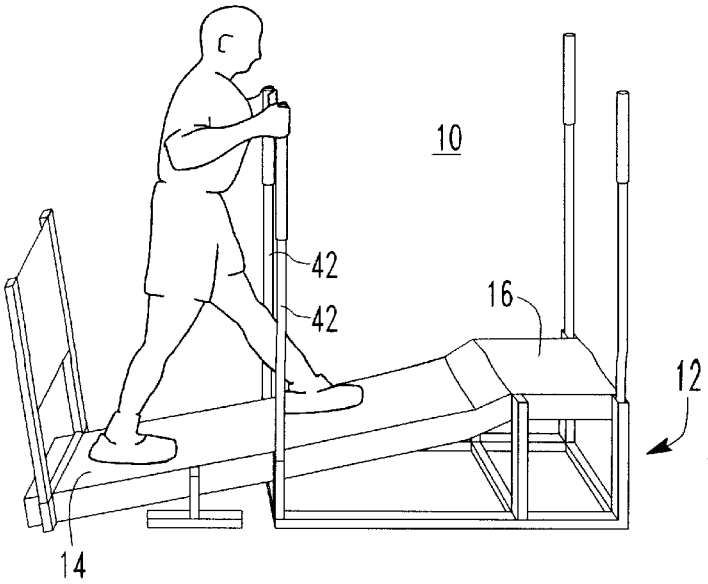
Figure 6A:
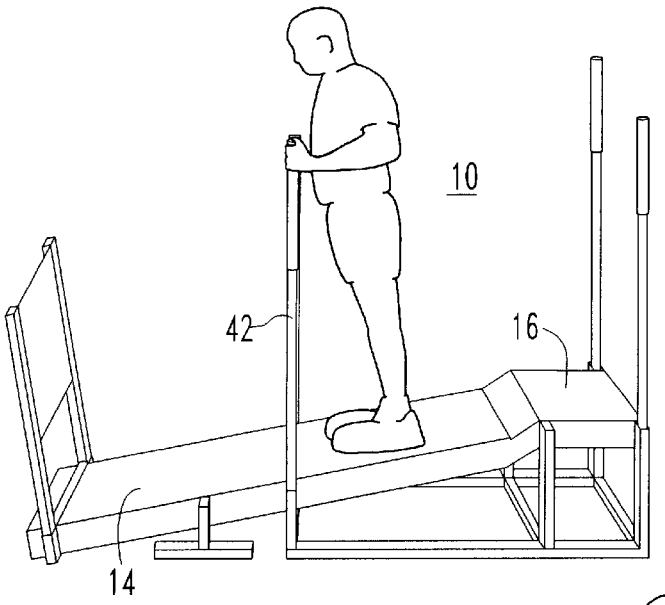
FIGS. 6A–6C illustrate an apparatus constructed according to the present invention being utilized to perform a third form of exercise.
Figure 6B:
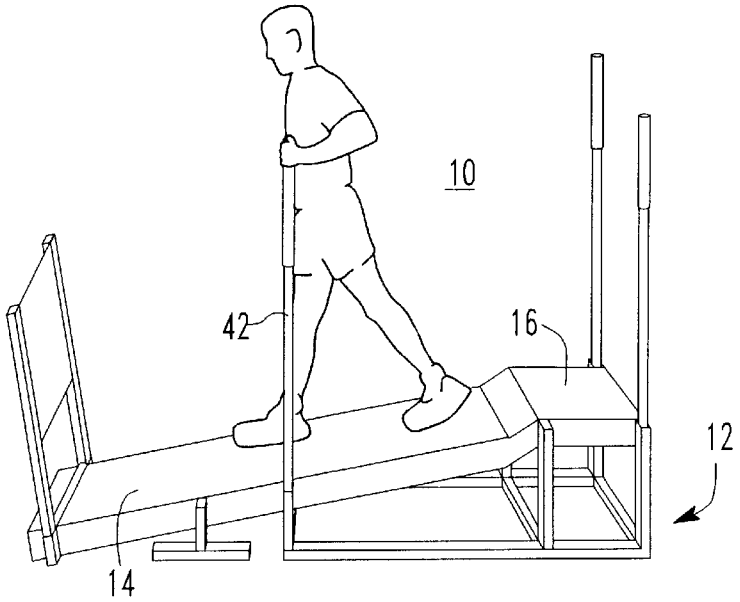
Figure 6C:
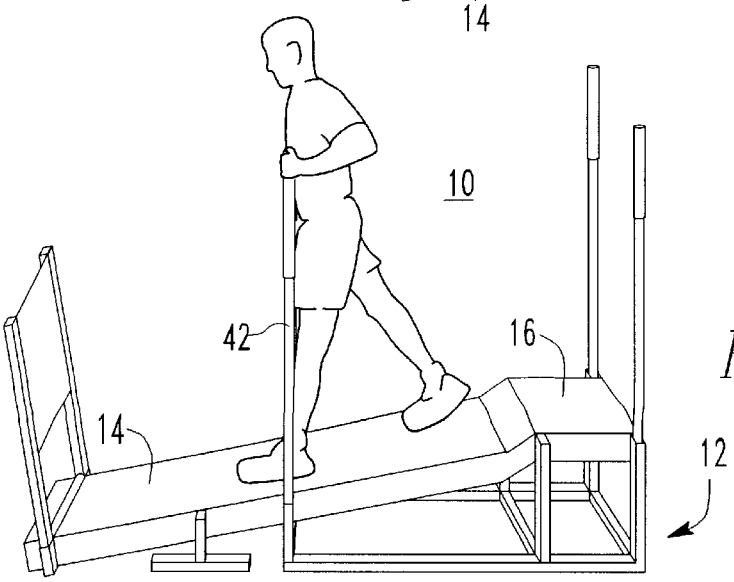
Figure 7A:
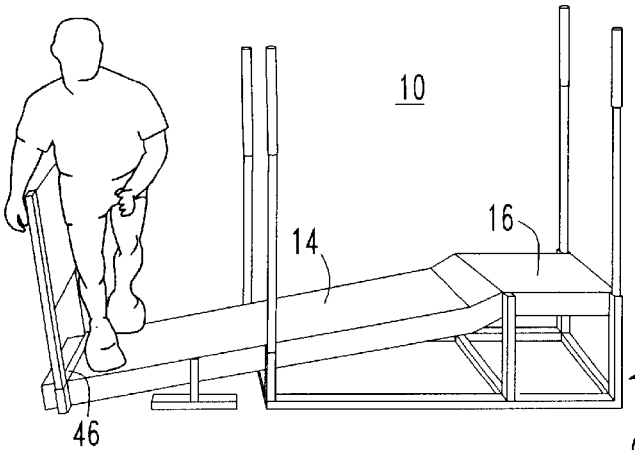
FIGS. 7A–7D illustrate an apparatus constructed according to the present invention being utilized to perform a fourth form of exercise.
Figure 7B:
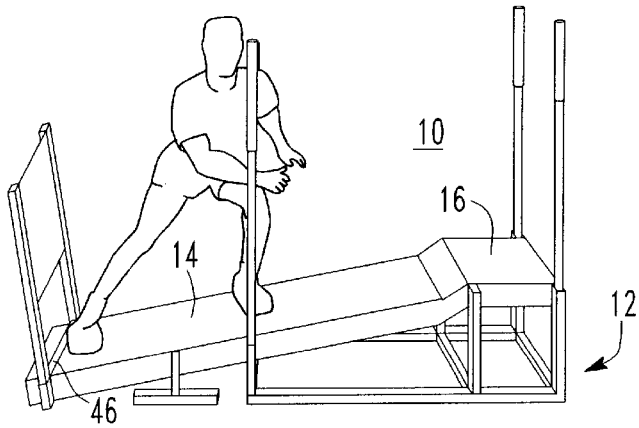
Figure 7C:
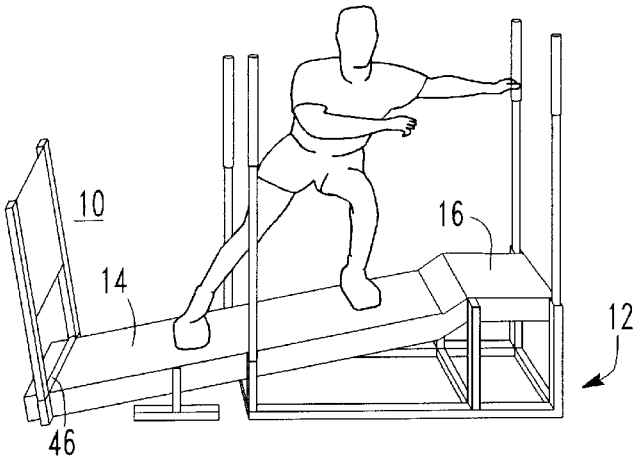
Figure 7D:
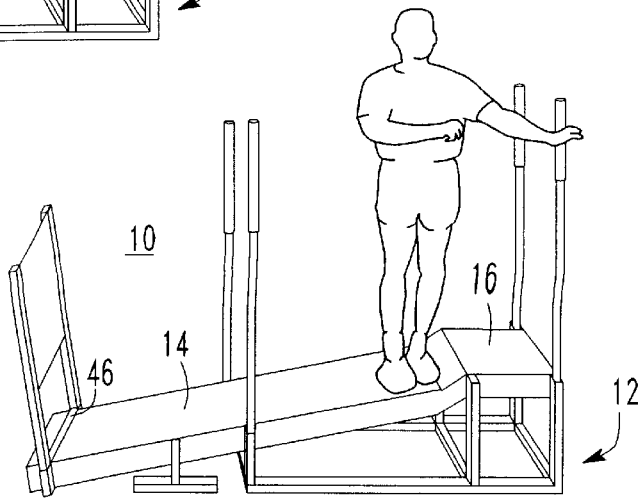
Figure 8A:
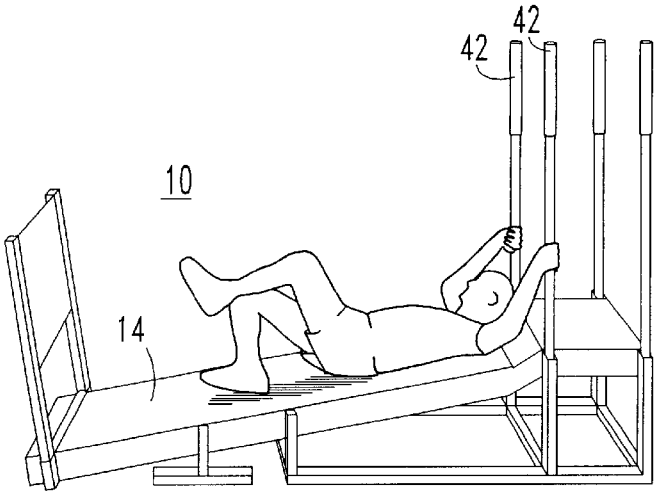
FIGS. 8A–8B illustrate an apparatus constructed according to the present invention being utilized to perform a fifth form of exercise.
Figure 8B:
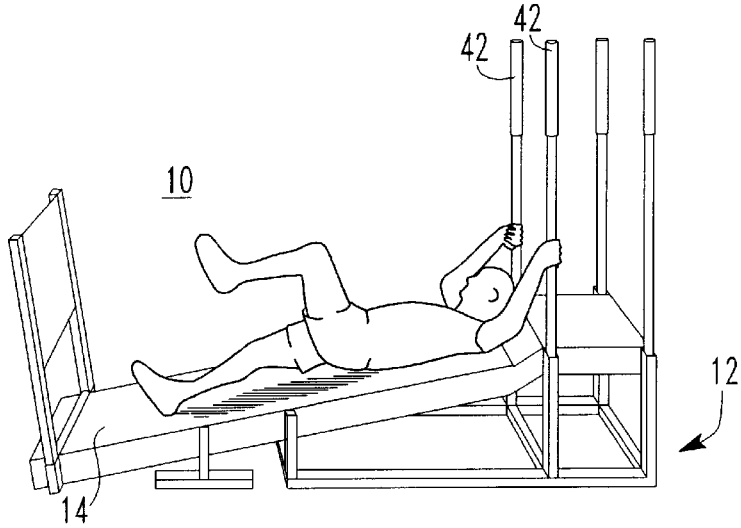
Figure 10A:
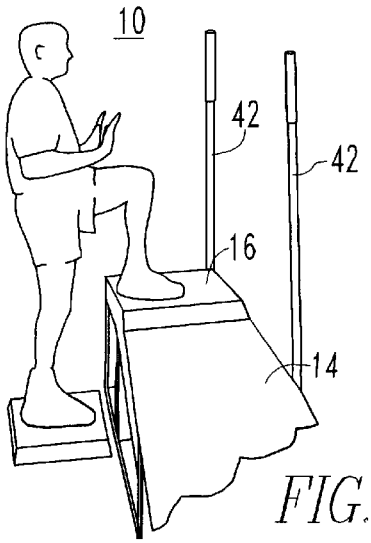
FIGS. 10A–10B illustrate an apparatus constructed according to the present invention being utilized to perform a seventh form of exercise.
Figure 10B:
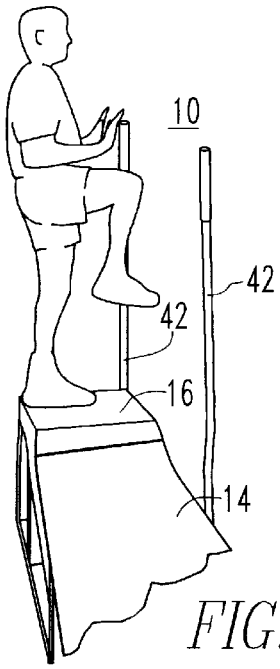
Figure 9A:
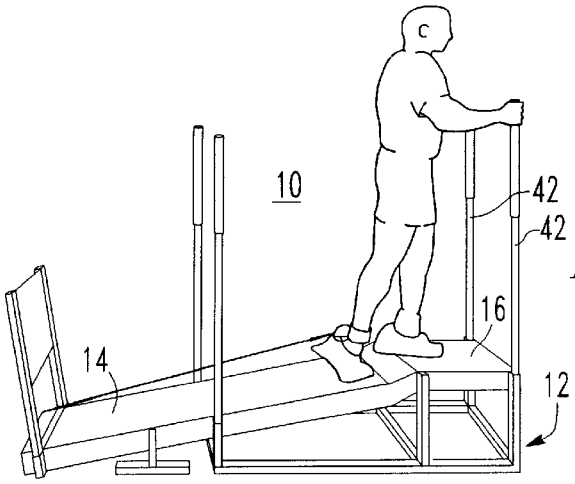
FIGS. 9A–9D illustrate an apparatus constructed according to the present invention being utilized to perform a sixth form of exercise.
Figure 9B:
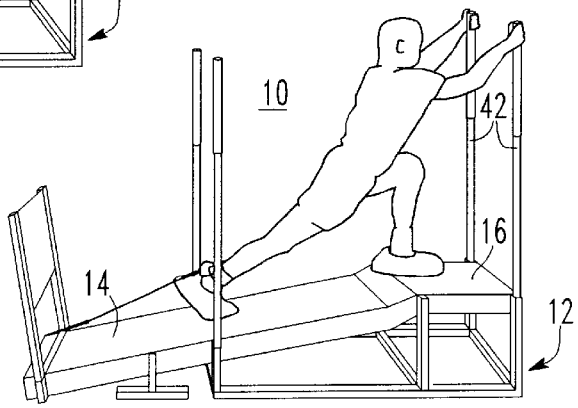
Figure 9C:
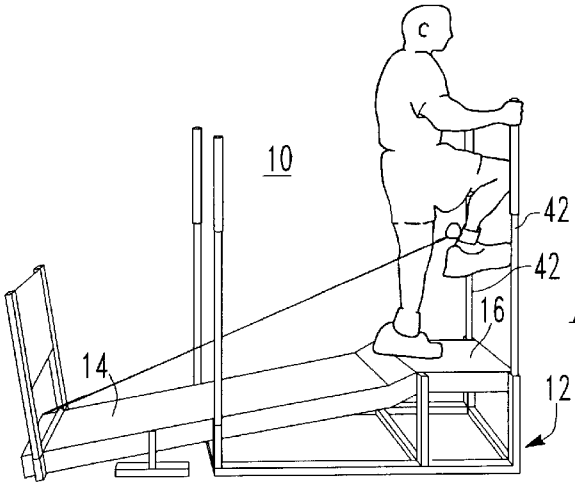
Figure 9D:
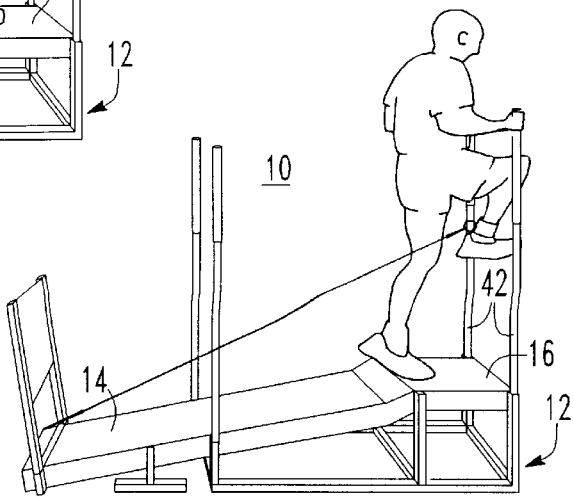
Figure 11A:
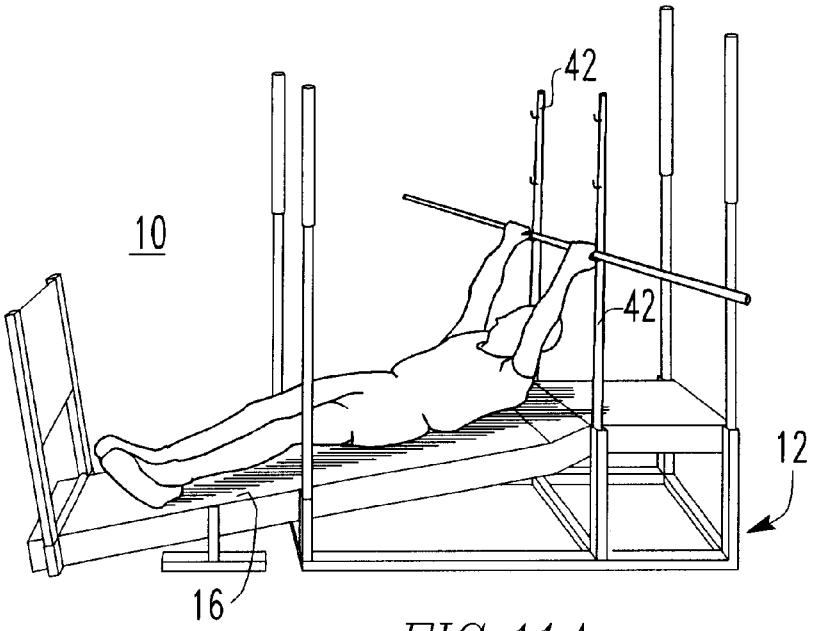
FIGS. 11A–11B illustrate an apparatus constructed according to the present invention being utilized to perform a eighth form of exercise.
Figure 11B:
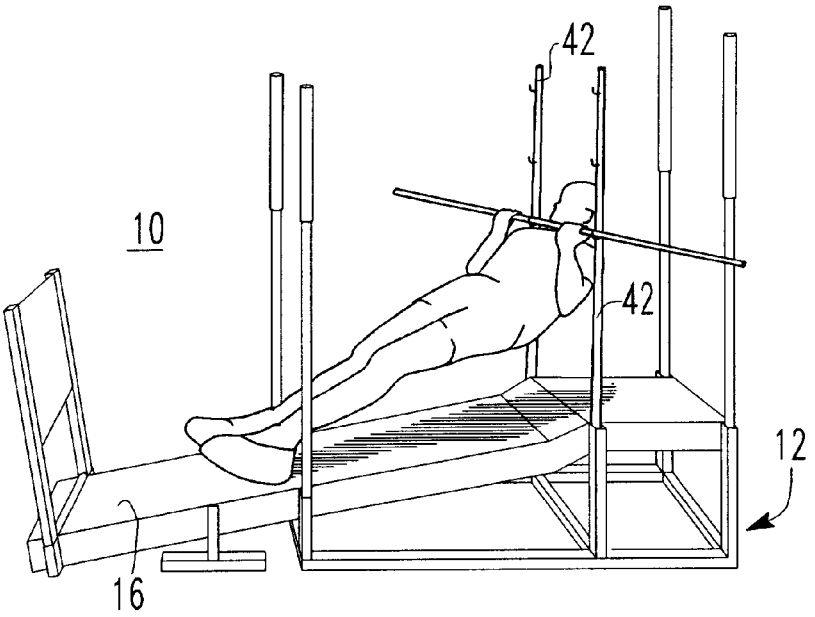

A plurality of poles 42, which may be removably inserted into the opening in the upright supports 22, are further provided to allow the user to perform further forms of exercise on the apparatus 10. For example, having removed the shuttle 30, the poles 42 may be placed in the openings in the upright supports 22 which are positioned proximate to the middle of the slide board 14 for purposes of configuring the apparatus 10 to allow the user to perform exercises of the form typically performed on dedicated cross-country ski machines. Specifically, these exercises are performed with the user gripping the poles 42 and sliding slippered feet along the slide board 14 to simulate uphill cross-country skiing as seen in FIGS. 5A–5C or downhill cross-country skiing as seen in FIGS. 6A–6C. The "uphill skiing" movement functions to advantageously bias the hip flexor musculature while the "downhill skiing" movement functions to advantageously bias the hip extensor musculature. The elimination of a fixed track and reciprocating poles in the subject invention, which components are typically found in prior art cross-country ski machines, has the further advantage of allowing the user to flex and extend the hips at a much faster rate while exercising the abdominal and oblique muscles which are required to help stabilize the pelvis and spine of the user and keep the legs moving in a somewhat linear fashion.

The apparatus 10 is further equipped with a bumper 46 mounted to the lower end of the slide board 14 for purposes of allowing the user to perform exercises of the form typically performed on conventional slide boards. As illustrated in FIGS. 7A–7D, the user, wearing slippers, performs the exercise by pushing off the bumper 46 which functions to propel the user up the inclined slide board 14. The use of a single bumper in connection with the inclined sliding surface allows the user to primarily work the push-off leg and tends to develop muscular power as opposed to muscular endurance which is a by product of performing exercises on conventional, flat slide boards. As will be apparent, performing this form of exercise on the subject invention also enhances stability and coordination as the user balances during movement up the inclined sliding surface.

Further forms of exercise which may be performed utilizing the subject invention are illustrated in FIGS. 8–12. Such exercises are illustrated for purposes of showing the versatility of the subject invention and are not intended to be limiting. For example, the platform 16 and the slide board 14 may be used in reverse lunge and side lunge variations, the platform 16 may be used to perform power stepups, single leg squats, heel raises, hip extensions, etc. To further assist in the performing of various of these exercises, the apparatus 10 may be equipped with a means for attaching an elastic cord, as illustrated in FIGS. 9A–9D, for providing the user with a means for adding a resistive force against which the user may work. Additionally, the poles 42 may be modified to carry a cross bar, as illustrated in FIGS. 11A–11B, for allowing the user to perform functional pull-ups.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any equivalent thereof.

What is claimed is:

1. An exercise apparatus, comprising:

a frame comprising a base, a plurality of support members extending upward from said base, a slide board carrying member carried by a first group of said plurality of support members, and a platform carrying member having a inner end and an outer end carried by a second group of said plurality of support members;

a slide board having an upper most end and a lower most end wherein said slide board is carried by said slide board carrying member, said slide board generally residing in a plane which is angled with respect to horizontal wherein the upper most end of said slide board carrying member is adjacently attached to said inner end of said platform carrying member;

a platform carried by said platform carrying member, said platform generally residing in a plane which is parallel with respect to horizontal and which meets said slide board at said upper most end of said slide board;

a pair of channels between which said slide board is generally disposed;

a reciprocal shuttle adapted to be removably carried within said pair of channels; and a plurality of upwardly extending poles adapted to be removably mated with a corresponding number of said plurality of support members.

2. The exercise apparatus as recited in claim 1, wherein said corresponding number of said plurality of support members are hollow and said plurality of poles are adapted to be carried within said corresponding number of said plurality of support members.

3. The exercise apparatus as recited in claim 1, wherein said pair of channels are mounted to said slide board carrying member.

4. The exercise apparatus as recited in claim 1, further comprising a foot plate connected to said frame proximate to the lower most side of said slide board.

5. The exercise apparatus as recited in claim 1, wherein said shuttle further comprises a means for overloading said shuttle.

6. The exercise apparatus as recited in claim 5, wherein said means for overloading said shuttle comprises a means for carrying a set of free weights.

7. The exercise apparatus as recited in claim 5, wherein said means for overloading said shuttle comprises an elastic cord attachable between said frame and said shuttle.

8. The exercise apparatus as recited in claim 1, wherein at least two of said plurality of poles are adapted to carry a cross bar therebetween.

9. The exercise apparatus as recited in claim 1, wherein said corresponding number of said plurality of support members are disposed generally midway between the upper most and lower most sides of said slide board.

10. The exercise apparatus as recited in claim 1, further comprising a bumper mounted adjacent to the lower most side of said slide board.

* * * * *